United States Patent [19]

Barker et al.

[11] 4,151,938

[45] May 1, 1979

[54] CARRYING BAG FOR FISHING TACKLE

[76] Inventors: Linvel Barker; Lillian F. Barker, both of 5931 W. 36th Ave., Gary, Ind. 46408

[21] Appl. No.: 885,673

[22] Filed: Mar. 13, 1978

[51] Int. Cl.[2] ..... A45C 1/04

[52] U.S. Cl. ..... 224/183; 224/236; 2/51; 224/268

[58] Field of Search ..... 224/26 E, 26 K, 26 D, 224/26 G, 26 R, 5 T, 5 G, 5 Q, 5 R; 2/51, 48; 24/3 F, 3 H; 150/1, 34, 35

[56] References Cited

U.S. PATENT DOCUMENTS

| | | | |
|---|---|---|---|
| 2,540,340 | 2/1951 | Linblade | 224/5 G |
| 2,580,913 | 1/1952 | Hawthorne | 224/5 G |
| 2,616,598 | 11/1952 | Sexton | 224/5 T |
| 3,004,315 | 10/1961 | Masure | 2/51 |
| 3,181,751 | 5/1965 | Wilson | 224/5 T |

*Primary Examiner*—Robert J. Spar
*Assistant Examiner*—Kenneth W. Noland

[57] ABSTRACT

An article in the form of a handbag for carrying fishing tackle. The bag is made with rear, middle and front walls, and joined in the center to form large rear and frontal pockets side by side. The rear pockets can be secured at the middle by snap fasteners; and the middle wall carries flaps to close over the frontal pockets with snap fasteners. In front of the frontal pockets are low pockets, also closable by snap fasteners. The bag is designed to be worn in front by the fisherman like an apron; and it secures support from the waist belt of the wearer by being made with upward straps at the center and sides which loop over the belt and are secured to the same in front by snap fasteners.

1 Claim, 8 Drawing Figures

FIG. 1
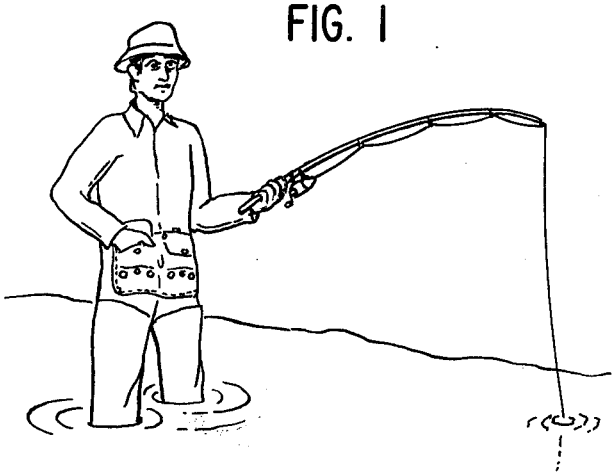
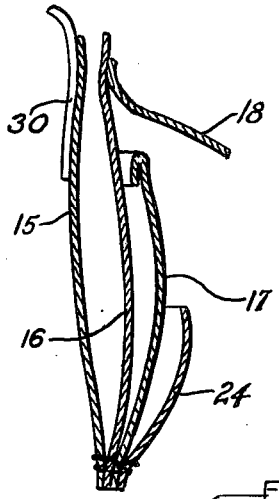
FIG. 3
FIG. 2
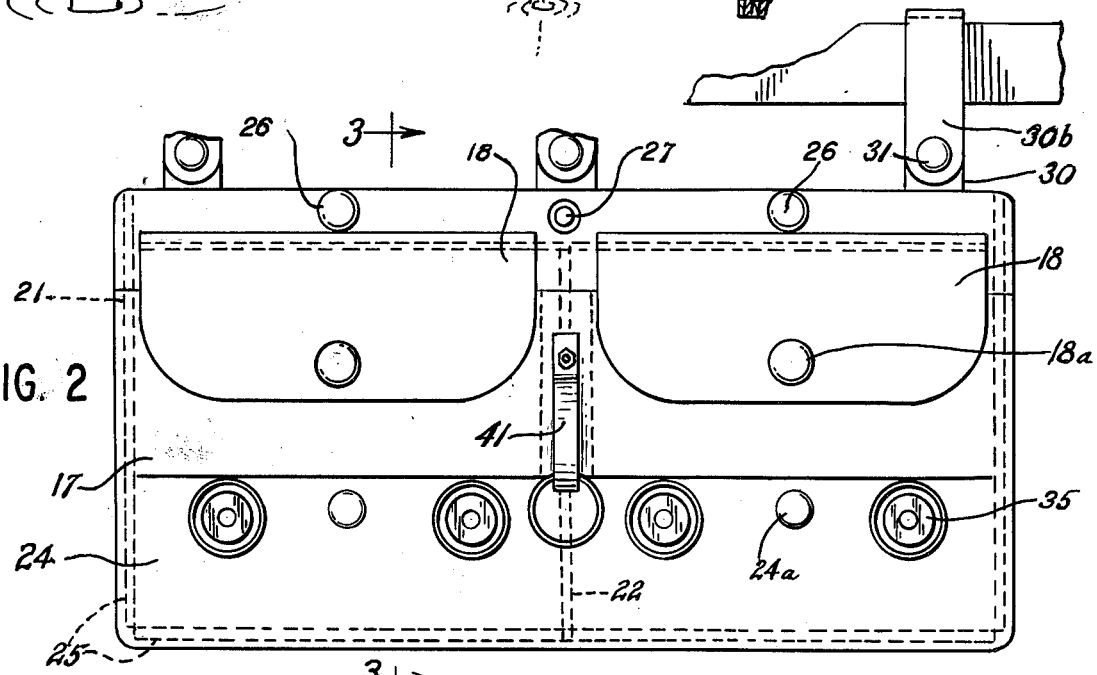
FIG. 4
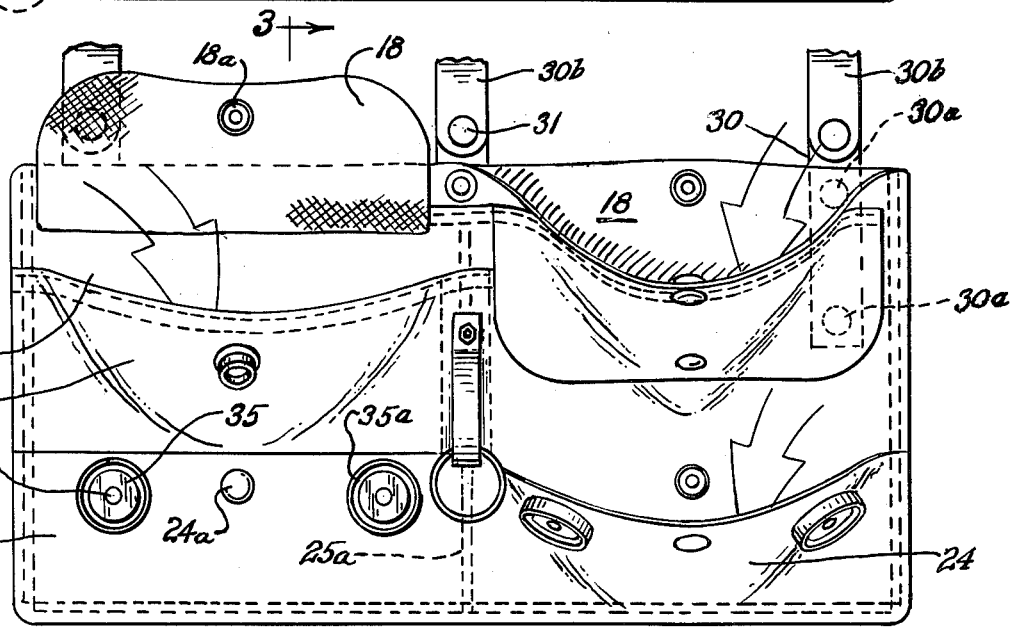

FIG. 5
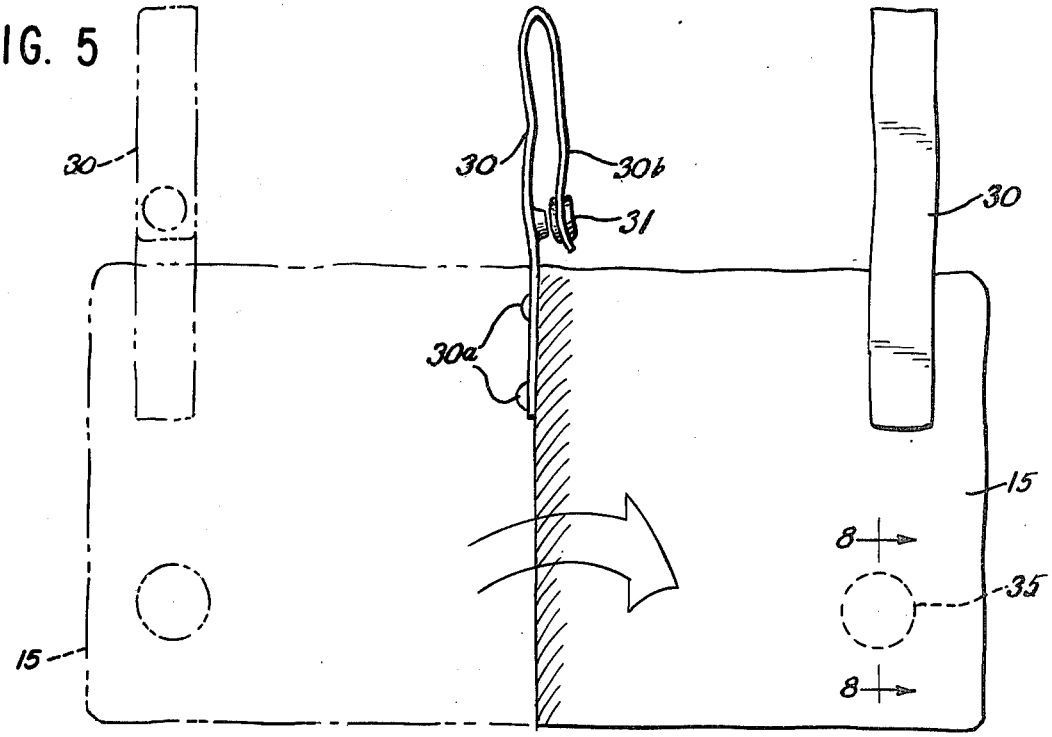
FIG. 6
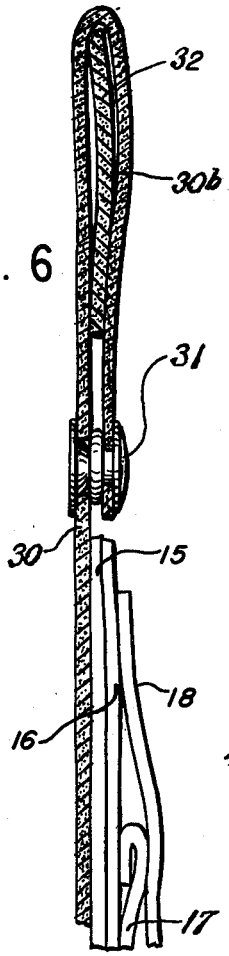
FIG. 7
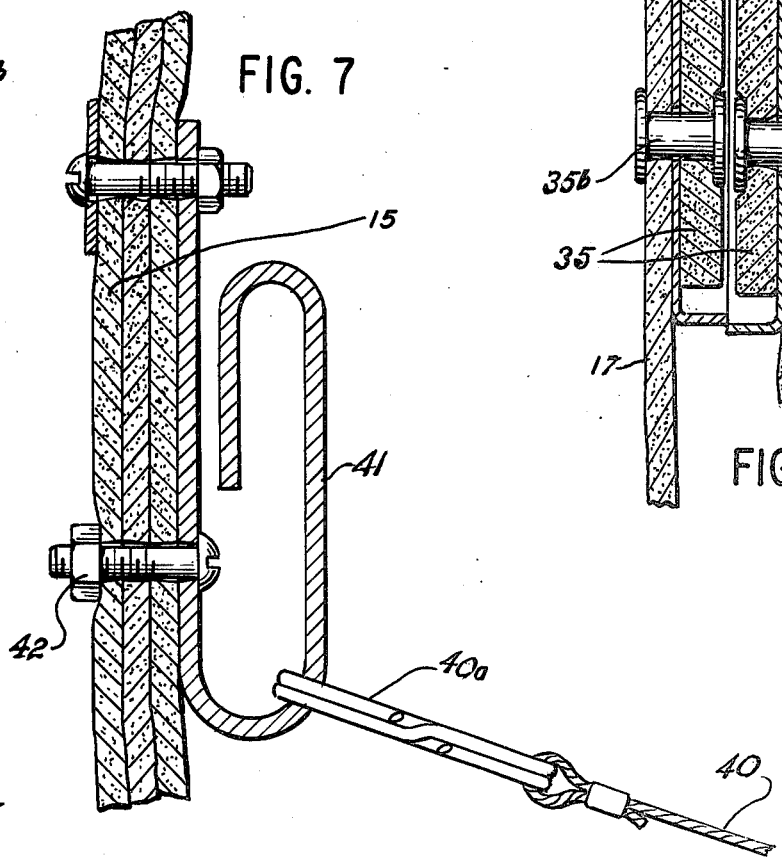
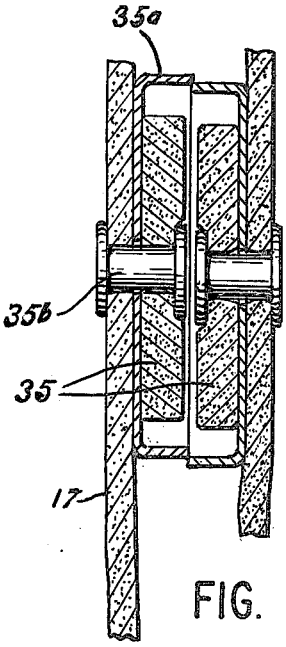
FIG. 8

CARRYING BAG FOR FISHING TACKLE

BACKGROUND OF THE INVENTION

Our invention relates to means for carrying fishing tackle, such as reels, lines, hooks, baits, lures, etc. Since such accessories tend to accumulate and become numerous, it is customary for fisherman to keep a good-sized tackle box handy, even though it is inconvenient to carry and occupies a considerable space when kept in a boat. Also, a tackle box is very cumbersome to use or handle when the fisherman is wading, for which reason it is usually left out of reach on a river bank or wharf. Further, whether the facility is a tackle box or even a hand bag, it requires one hand to carry it, leaving only the other hand to attend to the fishing rod, a catch of fish or the use of other accessories. Finally, a tackle box is often irritating from the noise it makes while handled or moved from place to place in a boat.

SUMMARY OF THE INVENTION

Since the above inconveniences make the handling and carrying of the conventional tackle box an unpleasant task, it is the main object of the present invention to provide an accessory for keeping fishing tackle which is worn by the fisherman, leaving both hands free to attend to all tasks involved in fishing.

A further object is to design the novel accessory as a carrying bag worn in front like an apron, and so compactly that it does not interfere with objects in the path of the fisherman's approach.

A still further object is to design the novel carrying bag for support from the fisherman's waist belt, making special attaching devices for this purpose unnecessary.

A final object is to construct the carrying bag like a wide wallet with pockets for various types and sizes of fishing tackle, and with handy closure flaps for the larger pockets.

BRIEF DESCRIPTION OF THE DRAWINGS

FIG. 1 is a pictorial view showing how the novel carrying bag is worn by a fisherman when wading;

FIG. 2 is a front elevation of the carrying bag, with portions at the top broken away;

FIG. 3 is a section on the line 3—3 of FIG. 2;

FIG. 4 is a view similar to FIG. 2 showing the closure flap of one pocket raised for access to the same;

FIG. 5 is view showing how the bag is foldable from the left side upon the other side to make a small package for storing or shipping;

FIG. 6 is an enlarged section of a supporting strap attached to the upper portion of the bag and suspended from the waist belt of the wearer;

FIG. 7 is a magnified section on the line 7—7 of FIG. 4, showing a fishing line engaging a hanger in front of the bag; and FIG. 8 is another magnified section of the folded bag in the region of line 8—8 in FIG. 5.

DESCRIPTION OF THE PREFERRED EMBODIMENT

The bag may be made of leather, canvas or other flexible fabric which is durable; and it is made with high rear and medial pockets for larger fishing accessories, such as reels, lures, spoons and the like, and with lower frontal pockets for smaller items, such as bait, fish hooks, floats and the like. While the pocket divisions could be several in lateral order, we have found pairs of them sufficient. Thus, specific reference to the drawings indicates that the high pockets are defined by a rear wall 15, a middle wall 16 and a front wall 17, such walls being secured at the sides and bottom by stitching 21, and in the center by stitching 22. The middle wall receives flaps 18 with snap fasteners **18*a* to secure the flaps to the front wall. The low pockets are defined by a front wall 24, with stitching 25 along the sides and bottom, and 25*a* in the center. However, the low pockets have no closure flaps because the small articles kept in them usually settle in the bottom. Also, absence of closure flaps makes it easier to reach into the lower pockets to deposit or remove some small article. However, the low pocket walls 24 carry fasteners 24*a* in case they are to be kept closed. The rear and middle walls of the bag are open or separable at the top to create large back pockets, as seen in FIG. 2, side by side for the convenient insertion or removal of large accessories. However, such walls have snap fasteners 26 at the sides and a rivet 27** in the center, the fasteners being secured when the bag is handled, tilted or not in use.

The arrow in the left upper portion of FIG. 4 shows the front wall 17 drawn forward to create an opening into it, while the upper arrow at the right in the same figure shows how the front wall 24 has been drawn forwardly to separate it from the front wall 17. Also, the large arrow in FIG. 5 shows how the left-hand portion of the bag — indicated by dot-and-dash lines — can be folded in forward direction to close on the right-hand portion and make the bag a small package for carrying, wrapping or storing it while not in use.

The most important feature of the invention is the means for supporting the carrying bag when worn as shown in FIG. 1. Such means is a series of vertical straps 30, one being in the center and two at the ends of the bag. The lower portions of the straps are attached by rivets **30*a* or other suitable means to the back wall 115 of the bag. The upper portions of the straps have frontal downfolds 30*b*, whose ends are secured to the main strap portions by snap fasteners 31. Thus, when the carrying bag is to be worn, the downfolds 30*b* are opened, inserted behind the wearer's waist belt 32** (see FIG. 6) folded down over the belt, and fastened together. The bag is now suspended from the waist belt, and needs no other means or attention for support.

It is sometimes desirable to take along or pick up small ferrous articles on the spur of the moment. The present bag carries magnetic discs 35 to quickly attach such articles where they can be seen, and not inside the bag. FIG. 8 shows the magnetic discs seating in cups **35*a*, and secured by rivets 35*b* to the front wall 15 of the bag. Also, the end of a fishing line 40 may be attached to the front of the bag by engaging the end-ring 40*a* of the line in a hanger 41 secured by bolts 42** to the center plies of the bag. It is desirable that the bag carry the external conveniences just mentioned.

It is now apparent that the present invention is a facility which is fairly thin when resting against the body of the wearer like an apron; and it has its own suspending means to loop over the wearer's waist belt and be secured by the snap fasteners 31 to hang from the same. Both hands of the wearer are thus free to engage in any task, or to hold the fishing rod in one hand while the other reaches into the convenient frontal pockets of the bag to deposit or remove fishing tackle. Also, the bag has the deep pockets for larger accessories, and the shallow open pockets below for smaller ones. The novel carrying bag is therefore a desirable and complete receptacle which needs no handling, moving from place to place with noise like a tackle box, or to be found in the way at times, since it is worn close to the body of the wearer, like an apron.

We claim:

1. A fisherman's bag for carrying fishing tackle, such bag having secured to a rear wall thereof a plurality of straps with upwardly extending portions forming a bight with down folds, which straps are looped over a waist belt worn by the fisherman and the down folds attached to the upwardly extending portion by means of operating snap elements on said down folds and upwardly extending portions;

said bag having a rear wall and a first front wall attached thereto to form a pair of first pockets which are opened at the top, and first co-operating fasteners on said rear and first front walls at their respective top portions to close said pocket;

said bag further having a second front wall attached to the outer surface of said first front wall to form a second pair of pockets;

a pair of flaps attached to said first front wall above said second front wall to overlap said second pockets, and second co-operating fasteners on said flaps and said second front wall to secure each said flap over its respective second pocket;

said bag also having a third front wall attached to the outer surface of said second front wall, the upper edge of said third front wall being below the lower edge of said flaps when closed to form a third pair of pockets which are open at the top, and third co-operating fasteners on said second and third front walls to close said third pair of pockets;

each of said third pair of pockets having a pair of magnetic means attached to the respective third front wall of each pocket to hold metal objects and to additionally hold the bag together when said pairs of pockets are folded over each other;

all of said walls being secured together along their respective lower and vertical edges and along the vertical center line of each of said walls; and the bag additionally having a metal U-shaped hook secured to said vertical center line, whereby an upper end portion of said hook is turned inwardly and downwardly to prevent accidental removal of objects from said hook.

* * * * *